US007854796B2

(12) United States Patent
Tokita et al.

(10) Patent No.: US 7,854,796 B2
(45) Date of Patent: Dec. 21, 2010

(54) LIQUID COMPOSITION, INK SET, AND INK TANK FOR INK JET RECORDING, INK JET RECORDING METHOD, AND INK JET RECORDING APPARATUS

(75) Inventors: Yoshimi Tokita, Kanagawa (JP); Takatsugu Doi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1147 days.

(21) Appl. No.: 11/503,030

(22) Filed: Aug. 11, 2006

(65) Prior Publication Data

US 2007/0188571 A1 Aug. 16, 2007

(30) Foreign Application Priority Data

Feb. 14, 2006 (JP) ..... 2006-037013

(51) Int. Cl.
*C09D 11/00* (2006.01)

(52) U.S. Cl. ..... 106/31.13; 106/31.27; 106/31.6

(58) Field of Classification Search ..... 106/31.13, 106/31.27, 31.6
See application file for complete search history.

(56) References Cited

U.S. PATENT DOCUMENTS 6,932,465 B2 * 8/2005 Nito et al. ..... 347/96
2005/0219341 A1 * 10/2005 Nito et al. ..... 347/100
2007/0146454 A1 * 6/2007 Doi et al. ..... 347/100

FOREIGN PATENT DOCUMENTS

| | | |
|---|---|---|
| JP | 08-020720 | 1/1996 |
| JP | 2004-300166 | 10/2004 |
| JP | 2005-336377 | 12/2005 |

* cited by examiner

*Primary Examiner*—Jessica L Ward
*Assistant Examiner*—Veronica Faison Gee
(74) *Attorney, Agent, or Firm*—Fildes & Outland, P.C.

(57) ABSTRACT

The invention provides a liquid composition for ink jet recording. The liquid composition contains an organic acid having a neutralization degree of 40 to 100%, a water-soluble organic solvent, water, and two or more kinds of positive ions including lithium ions. The content of the lithium ions with respect to the total mol number of the positive ions is about 20 to about 95 mol %. The invention also provides an ink set for ink jet recording that contains an ink including a coloring material, a water-soluble solvent, and water, and the liquid composition, and an ink jet recording method and an ink jet recording apparatus where the ink set is used.

15 Claims, 4 Drawing Sheets

LIQUID COMPOSITION, INK SET, AND INK TANK FOR INK JET RECORDING, INK JET RECORDING METHOD, AND INK JET RECORDING APPARATUS

BACKGROUND

1. Technical Field

The present invention relates to a liquid composition, an ink set, and an ink tank for ink jet recording, an ink jet recording method, and an ink jet recording apparatus.

2. Related Art

Many of printers currently used are ink jet recording apparatuses in which an ink is ejected from ink ejection ports of nozzles, slits or a porous film, since they have a small size and are inexpensive. Among the ink jet recording apparatuses, a piezo ink jet recording apparatus in which an ink is ejected by utilizing deformation of piezoelectric elements, and a thermal ink jet recording apparatus in which an ink is ejected by utilizing boiling phenomenon of an ink caused by thermal energy have a high resolution and a high-speed printing property.

Currently, one of the important issues for ink jet recording apparatuses is achieving higher speed printing and higher image quality on plain paper.

When an image is formed on a recording medium using ink of low viscosity, the phenomena of decreasing image optical density, ink feathering, or curling of paper, which occur due to ink (including a coloring material) infiltrating inside the paper, have been identified.

One measure to improve this problem is increasing the amount of the solvent in a liquid composition or ink. However, increasing the amount of the solvent results in a decrease in the content of water in the liquid composition or ink. As a result, the effective concentration of the electrolyte in the liquid composition or ink increases, which may cause precipitation of the aggregating agent or the surfactant in the liquid composition or ink.

SUMMARY

According to an aspect of the invention, there is provided a liquid composition for ink jet recording including an organic acid, a water-soluble organic solvent, water, and two or more kinds of positive ions including lithium ions, the content of the lithium ions with respect to the total mol number of the positive ions being about 20 to about 95 mol %, and the organic acid has a neutralization degree of about 40 to 100%.

BRIEF DESCRIPTION OF THE DRAWINGS

Exemplary embodiments of the invention will be described in detail based on the following figures, wherein.

DETAILED DESCRIPTION

Figure 1:
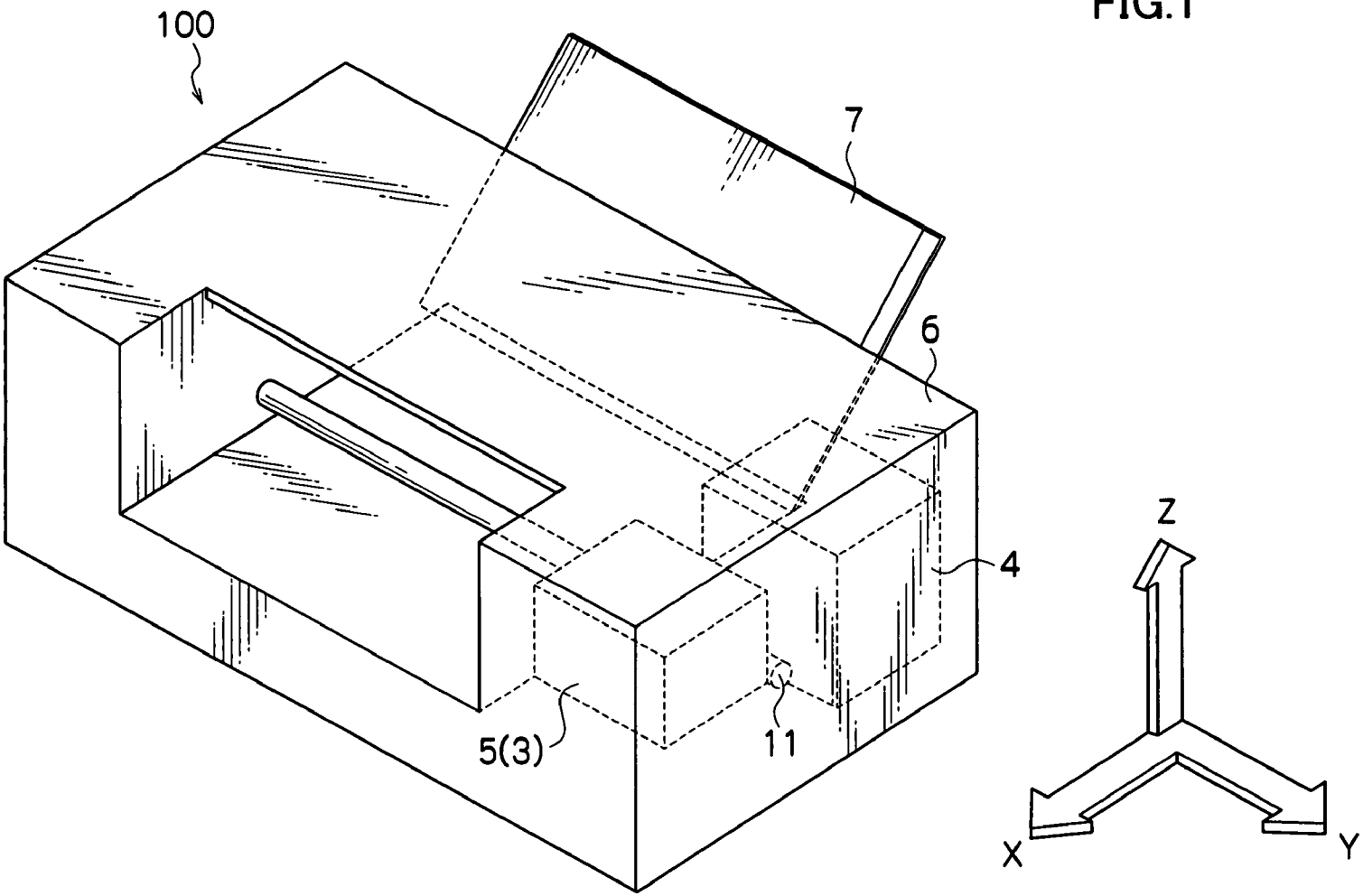
FIG. 1 is a perspective view showing the exterior configuration of one preferred exemplary embodiment of an ink jet recording apparatus of the invention.

Hereinafter, the invention will be explained in detail.

Ink Set for Ink Jet Recording

The ink set for ink jet recording of the invention includes an ink for ink jet recording (hereinafter, referred to as an ink in some cases) and a liquid composition for ink jet recording (hereinafter, referred to as a liquid composition in some cases) having the function of aggregating or insolubilizing the ink (particles) for ink jet recording.

The liquid composition for ink jet recording includes at least two kinds of positive ions, at least one organic acid having a neutralization degree of about 40 to 100%, at least one water-soluble organic solvent, and water. The positive ions include lithium ions, and the content of the lithium ions with respect to the total mol number of the positive ions is about 20 to about 95 mol %.

Since the ink set includes such a liquid composition, stable ejection of the liquid composition from the nozzle can be ensured and the difference between the real direction of the liquid composition ejected and a desired direction of liquid composition ejection can be lessened. The reason for these is supposedly as follows. Precipitation of the organic acid in the liquid composition at the time that the water contained in the liquid composition is evaporating is prevented at the tip portions of the nozzles of an ink jet recording apparatus.

Use of a liquid composition including an aggregating agent such as an organic acid to aggregate coloring material particles in the ink and to improve image quality such as optical density is conventionally known. However, since such a liquid composition is attached to a recording medium as well as an ink in this case, the total amount of water attached to the recording medium consequently increases, which may cause the recording medium to curl. One measure against the curling is substitution of a water-soluble organic solvent for at least a part of water contained in the ink and the liquid composition. However, this may worsen clogging of the nozzles. The cause of this is supposedly as follows. Because such a liquid composition consequently includes a decreased content of water, which dissolves the organic acid, the organic acid may undesirably precipitate in the vicinities of the openings of the nozzles. In contrast, it has been found that a liquid composition including an appropriate amount of lithium ions, such as the liquid composition of the invention, can effectively prevent clogging of nozzles even if the content of water in the liquid composition is reduced. The mechanism has not been cleared, but is supposedly as follows. Each lithium ion has a large hydration radius and is ionically associated with many water molecules. As a result, even when the water in the liquid composition has evaporated in the vicinities of the openings of the nozzles, the lithium ions are useful in keeping the organic acid dissolved and preventing the organic acid from precipitating.

Liquid Composition for Ink Jet Recording

Hereinafter, the liquid composition for ink jet recording of the invention will be explained in detail.

The liquid composition for ink jet recording of the invention includes at least one organic acid, at least one water-soluble organic solvent, water and two or more kinds of positive ions including lithium ions. The content of the lithium ions with respect to the total mol number of the positive ions is about 20 to about 95 mol %. Each of the at least one organic acid has a neutralization degree of about 40 to 100%.

Two or More Kinds of Positive Ions

As described above, the liquid composition of the invention includes the two or more kinds of positive ions to prevent precipitation of the at least one organic acid. As described above, the positive ions include lithium ions and the content of the lithium ions with respect to the total mol number of the positive ions is about 20 to about 95 mol %.

Inclusion of about 20 to about 95 mol % of the lithium ions may prevent precipitation of the at least one organic acid. The content of the lithium ions is preferably about 30 to about 90 mol %, and more preferably about 40 to about 85 mol %. When the content of the lithium ions is less than about 20 mol %, such an ink has a decreased moisture retaining effect and the organic acid may easily precipitate. When the content exceeds about 95 mol %, such an ink has an extremely high moisture retaining effect and the water-soluble solvent may precipitate.

The positive ions other than the lithium ions are preferably one or more kinds selected from alkaline metal ions, organic amines, and onium ions.

Examples of each of the alkaline metal ions include a sodium ion and a potassium ion.

Examples of a compound containing such an alkaline metal ion include sodium hydroxide, potassium hydroxide, and salts of alkaline metals such as sodium chloride, potassium chloride, sodium bromide, potassium bromide, sodium iodide, potassium iodide, sodium sulfate, potassium nitrate, sodium acetate, potassium oxalate, sodium citrate, and potassium benzoate.

Each of the organic amines that can be used in the invention may be primary, secondary, tertiary or quaternary amine or a salt thereof. More specifically, each of the organic amines can be tetraalkyl ammonium, alkylamine, benzalconium, alkylpyridium, imidazolium, polyamine, or a derivative or salt thereof.

Specific examples thereof include amylamine, butylamine, propanolamine, propylamine, ethanolamine, ethylethanolamine, 2-ethylhexylamine, ethyl methyl amine, ethyl benzyl amine, ethylenediamine, octylamine, oleylamine, cyclooctylamine, cyclobutylamine, cyclopropylamine, cyclohexylamine, diisopropanolamine, diethanolamine, diethylamine, di-2-etylhexylamine, diethylenetriamine, diphenylamine, dibutylamine, dipropylamine, dihexylamine, dipentylamine, 3-(dimethylamino)propylamine, dimethyl ethyl amine, dimethyl ethylene diamine, dimethyl octyl amine, 1,3-dimethylbutylamine, dimethyl-1, 3-propanediamine, dimethyl hexyl amine, aminobutanol, aminopropanol, aminopropanediol, N-acetylaminoethanol, 2-(2-aminoethylamino)-ethanol, 2-amino-2-ethyl-1,3-propanediol, 2-(2-aminoethoxy)ethanol, 2-(3,4-dimethoxyphenyl)ethylamine, cetylamine, triisopropanolamine, triisopentylamine, triethanolamine, trioctylamine, tritylamine, bis(2-aminoethyl)1,3-propanediamine, bis(3-aminopropyl)ethylenediamine, bis(3-aminopropyl)1, 3-propanediamine, bis(3-aminopropyl)methylamine, bis(2-ethylhexyl)amine, bis(trimethylsilyl)amine, butyl isopropyl amine, propanediamine, propyldiamine, hexylamine, pentylamine, 2-methyl-cyclohexylamine, methyl-propylamine, methyl benzyl amine, monoethanolamine, laurylamine, nonylamine, trimethylamine, triethylamine, dimethyl propyl amine, propylenediamine, hexamethylenediamine, tetraethylenepentamine, diethylethanol amine, tetramethyl ammonium chloride, tetraethyl ammonium bromide, dihydroxyethyl stearyl amine, 2-heptadecenyl-hydroxyethylimidazoline, lauryl dimethyl benzyl ammonium chloride, cetylpyridinium chloride, stearamid methyl pyridium chloride, a diallyl dimethyl ammonium chloride polymer, a diallylamine polymer, and a monoallylamine polymer.

Examples of each of the onium ions in the invention include an ammonium ion, a sulfonium ion, a phosphonium ion, an iodonium ion, and an oxonium ion.

A compound containing an ammonium ion may have the following structure.

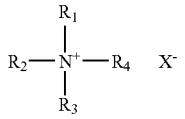

In this structure, each of $R_1$ to $R_4$ represents a hydrogen atom, or a substituent. The substituent is an alkyl group, an allyl group, an aryl group, a phenyl group, a saturated or unsaturated carbocyclic or heterocyclic group, an alkoxy group, an aryloxy group, or an amino group. The substituent may have at least one substituent. $X^-$ represents a counter ion.

A compound containing a sulfonium ion may have the following structure.

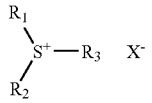

In this structure, each of $R_1$ to $R_3$ represents a hydrogen atom, or a substituent. The substituent is an alkyl group, an allyl group, an aryl group, a phenyl group, a saturated or unsaturated carbocyclic or heterocyclic group, an alkoxy group, an aryloxy group, or an amino group. The substituent may have at least one substituent. $X^-$ represents a counter ion.

Examples of such a compound include (2-carboxyethyl) dimethyl sulfonium chloride and (2-carboxyethyl) dimethyl sulfonium bromide.

A compound containing a phosphonium ion may have the following structure.

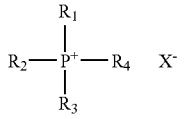

In this structure, each of $R_1$ to $R_4$ represents a hydrogen atom, or a substituent. The substituent is an alkyl group, an allyl group, an aryl group, a phenyl group, a saturated or unsaturated carbocyclic or heterocyclic group, an alkoxy group, an aryloxy group, or an amino group. The substituent may have at least one substituent.) $X^-$ represents a counter ion.

Examples of such a compound include n-butyl triphenyl phosphonium bromide, (3-carboxypropyl) triphenyl phosphonium bromide, and methyl triphenyl bromide.

An iodonium salt may be a compound having the following structure.

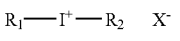

In this structure, each of $R_1$ and $R_2$ represents a hydrogen atom, or a substituent. The substituent is an alkyl group, an allyl group, an aryl group, a phenyl group, a saturated or unsaturated carbocyclic or heterocyclic group, an alkoxy group, an aryloxy group, or an amino group. The substituent may have at least one substituent. $X^-$ represents a counter ion.

Examples of the iodonium salt include diphenyliodonium chloride and diphenyliodonium-2-carboxylate monohydrate.

A compound containing an oxonium ion may have the following structure.

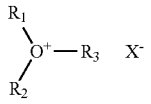

In this structure, each of $R_1$ to $R_3$ represents a hydrogen atom, or a substituent. The substituent is an alkyl group, an allyl group, an aryl group, a phenyl group, a saturated or unsaturated carbocyclic or heterocyclic group, an alkoxy group, an aryloxy group, or an amino group. The substituent may have at least one substituent. $X^-$ represents a counter ion.

Examples of such a compound include trimethyl oxonium tetrafluouoborate and triethyl oxonium tetrafluouoborate.

Each of at least one compound having a positive ion other than a lithium ion is preferably sodium hydroxide, potassium hydroxide, ammonia, tetramethyl ammonium hydroxide, dimethylamine, 2-aminoethanol, or triethanolamine, because such a compound can be preferably used in combination with lithium ions.

When the organic acid is a compound including a nitrogen atom, at least one compound having a positive ion other than a lithium ion preferably includes tetramethyl ammonium hydroxide.

Organic Acid

In order to aggregate or insolubilize the components of the ink, the liquid composition of the invention includes an organic acid having a neutralization degree of about 40 to 100%. The organic acid may be any compound having a neutralization degree of about 40 to 100%.

Use of the organic acid having a neutralization degree of about 40 to 100% keeps the degree of aggregation of the components contained in the mixture of the ink and the liquid composition moderate, and may provide a printed matter obtained by using the ink set with an increased optical density.

The neutralization degree is preferably about 45 to about 90%, more preferably about 50 to about 80%, and still more preferably about 50 to about 75%.

When the neutralization degree is less than about 40%, the organic acid may easily precipitate.

Specific examples of the organic acid include arginic acid, citric acid, glycin, glutamic acid, succinic acid, tartaric acid, cysteine, oxalic acid, fumaric acid, phthalic acid, maleic acid, malonic acid, ricin, malic acid, itaconic acid, and compounds represented by Formula (1), and derivatives thereof Formula (1)

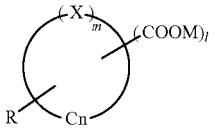

In Formula (1), X represents O, CO, NH, $NR_1$, S, or $SO_2$. $R_1$ represents a substituted or unsubstituted alkyl group. $R_1$ is preferably $CH_3$, $C_2H_5$, or $C_2H_4OH$. R represents a hydrogen or a substituted or unsubstituted alkyl group. R is preferably $CH_3$, $C_2H_5$, or $C_2H_4OH$. However, Formula (1) may or may not include R. X is preferably CO, NH, NR, or O, and more preferably CO, NH, or O. M represents a hydrogen atom, an alkali metal, or an amine. M is preferably H, Li, Na, K, monoethanolamine, diethanolamine, or triethanolamine, more preferably H, Na, or K, and still more preferably a hydrogen atom. In Formula (1), n represents an integer of 3 to 7. In Formula (1), n preferably represents such an integer that the heterocyclic ring including Cn is a 5- or 6-membered ring. More preferably, n represents such an integer that the heterocyclic ring including Cn is a 5-membered ring. In Formula (1), m represents 1 or 2. The compound represented by Formula (1) may be a saturated or unsaturated heterocyclic ring. In Formula (1), l represents an integer of 1 to 5.

The compound represented by Formula (1) may have a structure selected from furan, pyrrole, pyrroline, pyrolidone, pyrone, thiophene, indole, pyridine, and quinoline and, as at least one functional group, at least one carboxyl group. Specific examples thereof include 2-pyrolidone-5-carboxylic acid, 4-methyl-4-pentanolide-3-carboxylic acid, furancarboxylic acid, 2-benzofurancarboxylic acid, 5-methyl-2-furancarboxylic acid, 2,5-dimethyl-3-furancarboxylic acid, 2-furandicarboxylic acid, 2,5-furandicarboxylic acid, 4-butanolide-3-carboxylic acid, 3-hydroxy-4-pyrone-2,6-dicarboxylic acid, 2-pyrone-6-carboxylic acid, 4-pyrone-2-carboxylic acid, 5-hydroxy-4-pyrone-5-carboxylic acid, 4-pyrone-2,6-dicarboxylic acid, 3-hydroxy-4-pyrone-2,6-dicarboxylic acid, thiophenecarboxylic acid, 2-pyrrolecarboxylic acid, 2,3-dimethylpyrrole-4-carboxylic acid, 2,4,5-trimethylpyrrole-3-propionic acid, 3-hydroxy-2-indolecarboxylic acid, 2,5-dioxo-4-methyl-3-pyrroline-3-propionic acid, 2-pyrrolidinecarboxylic acid, 4-hydroxyproline, 1-methylpyrrolidine-2-carboxylic acid, 5-carboxy-1-methylpyrrolidine-2-acetic acid, 2-pyridinecarboxylic acid, 3-pyridinecarboxylic acid, 4-pyridinecarboxylic acid, pyridinedicarboxylic acid, pyridinetricarboxylic acid, pyridinepentacarboxylic acid, 1,2,5,6-tetrahydro-1-methylnicotinic acid, 2-quinolinecarboxylic acid, 4-quinolinecarboxylic acid, 2-phenyl-4-quinolinecarboxylic acid, 4-hydroxy-2-quinolinecarboxylic acid, and 6-methoxy-4-quinolinecarboxylic acid.

The organic acid is preferably citric acid, glycine, glutamic acid, succinic acid, tartaric acid, phthalic acid, pyrolidonecarboxylic acid, pyronecarboxylic acid, pyrrolecarboxylic acid, furancarboxylic acid, pyridinecarboxylic acid, coumaric acid, thiophenecarboxylic acid, or nicotinic acid, or a derivative or salt thereof. The organic acid is more preferably pyrolidonecarboxylic acid, pyronecarboxylic acid, pyrrolecarboxylic acid, furancarboxylic acid, pyridinecarboxylic acid, coumaric acid, thiophenecarboxylic acid, or nicotinic acid, or a derivative or salt thereof. The organic acid is still more preferably pyrolidonecarboxylic acid, pyronecarboxylic acid, furancarboxylic acid, or coumaric acid, or a derivative or salt thereof.

Only one of these organic acids can be used, or two or more of them can be used together.

The content of the organic acid(s) in the liquid composition is preferably about 0.03 to about 0.2 mol/liter, more preferably about 0.04 to about 0.18 mol/liter, and still more preferably about 0.06 to about 0.15 mol/liter. When the content of the organic acid(s) added is less than about 0.03 mol/liter, the coloring material particles insufficiently aggregate at the time that the ink has been brought into contact with the liquid composition, which may result in a decreased optical density. On the other hand, when the content of the organic acid(s) added exceeds about 0.2 mol/liter, the coloring material particles extremely strongly aggregate, which may result in narrowed dots and a decreased optical density.

Aggregating Agent

The liquid composition of the invention may contain at least one aggregating agent that aggregates the components of the ink to such an extent that the effect of the invention is not lost.

Examples of the aggregating agent include salts of alkali metal ions, multivalent metal ions and acids. Examples of each of the alkali metal ions include a lithium ion, a sodium ion, and a potassium ion. Examples of each of the multivalent metal ions include an aluminum ion, a barium ion, a calcium ion, a copper ion, an iron ion, a magnesium ion, a manganese ion, a nickel ion, a tin ion, a titanium ion, and a zinc ion. Examples of each of the acids include hydrochloric acid, hydrobromic acid, hydroiodic acid, sulfuric acid, nitric acid, phosphoric acid, thiocyanic acid, organic carboxylic acids such as acetic acid, oxalic acid, lactic acid, fumaric acid, citric acid, salicylic acid, and benzoic acid, and organic sulfonic acids.

Specific examples of the alkali metal salt include lithium chloride, sodium chloride, potassium chloride, sodium bromide, potassium bromide, sodium iodide, potassium iodide, sodium sulfate, potassium nitrate, sodium acetate, potassium oxalate, sodium citrate, and potassium benzoate. Examples of the multivalent metal salt include aluminum chloride, aluminum bromide, aluminum sulfate, aluminum nitrate, sodium aluminum sulfate, potassium aluminum sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogen phosphate, calcium thiocyanate, calcium benzoate, calcium acetate, calcium salicylate, calcium tartrate, calcium lactate, calcium fumarate, calcium citrate, copper chloride, copper bromide, copper sulfate, copper nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogen phosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate.

The aggregating agent is preferably a multivalent metal salt. This is because the multivalent metal salt effectively aggregates the components of the ink, greatly improves an optical density, and effectively prevents feathering and intercolorbleeding.

The liquid composition of the invention may contain one or more of the multivalent metal salts. Moreover, the content of the multivalent metal salt(s) in the liquid composition is preferably about 0.01 to about 15% by mass, and more preferably about 0.1 to about 10% by mass.

Each of the at least one water-soluble organic solvent contained in the liquid composition for ink jet recording is, for example, polyhydric alcohol, a polyhydric alcohol derivative, a nitrogen-containing solvent, alcohol, or a sulfur-containing solvent.

Specific examples of the polyhydric alcohol include ethylene glycol, diethylene glycol, propylene glycol, butylene glycol, triethylene glycol, 1,5-pentanediol, 1,2,6-hexanetriol and glycerin.

Specific examples of the polyhydric alcohol derivative include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and an adduct obtained by adding ethylene oxide to diglycerin.

Specific examples of the nitrogen-containing solvent include pyrolidone, N-methyl-2-pyrolidone, cyclohexylpyrolidone, triethanolamine. Specific examples of the alcohol include ethanol, isopropyl alcohol, butyl alcohol, and benzyl alcohol. Specific examples of the sulfur-containing solvent include thiodiethanol, thiodiglycerol, sulfolane, and dimethyl sulfoxide. Alternatively, the water-soluble organic solvent may be propylene carbonate or ethylene carbonate.

The liquid composition may contain one or more water-soluble organic solvent, as described above.

The amount (molar amount) of the water-soluble organic solvent(s) is preferably at least 1.5 times the molar amount of the organic acid(s), more preferably at least 2.0 times, and still more preferably at least 2.5 times.

When the molar amount of the water-soluble organic solvent(s) is less than 1.5 times that of the organic acid(s), a recording medium may be unsatisfactorily prevented from curling.

The content of the water-soluble organic solvent(s) in the liquid composition is preferably about 1 to about 60% by mass, and more preferably about 5 to about 40% by mass. When the content of the water-soluble organic solvent(s) is less than about 1% by mass, a sufficient optical density may not be obtained. On the other hand, when the content of the water-soluble organic solvent(s) is more than about 60% by mass, such a liquid composition may have an increased viscosity and unstable jettability.

The amount of the water-soluble organic solvent(s) is so preferably determined as to obtain a desired combination of the content of the water-soluble organic solvent(s) in the liquid composition and the molar amount ratio of the water-soluble organic solvent(s) to the organic acid(s).

Preferred Physical Characteristics of Liquid Composition

The surface tension of the liquid composition for ink jet recording is preferably about 20 to about 50 mN/m, more preferably about 23 to about 40 mN/m, and still more preferably about 25 to about 35 mN/m. When the surface tension is less than about 20 mN/m, the liquid composition may leak out of nozzles and may not be normally jetted from the nozzles. On the other hand, when the surface tension exceeds about 50 mN/m, penetration of such a liquid composition into a recording medium may require longer time, which may lengthen a period from contact of the liquid composition with the recording medium to drying.

The pH of the liquid composition for ink jet recording is preferably about 2.5 to about 6.0, more preferably about 2.8 to about 5.5, and still more preferably about 3.0 to about 5.0. When the pH of the liquid composition for ink jet recording is less than about 2.5, the liquid composition may cause strong aggregation of the components of the ink, which may result in narrowed dots and a decreased optical density. On the other hand, when the pH of the liquid composition for ink jet recording is more than about 6.0, the liquid composition may insufficiently aggregate the components of the ink, which may lead to a decreased optical density.

The viscosity of the liquid composition for ink jet recording is preferably about 1.2 mPa·s to about 8.0 mPa·s, more preferably not less than about 1.5 mPa·s and less than about 6.0 mPa·s, and still more preferably not less than about 1.8 mPa·s and less than about 4.5 mPa·s. When the viscosity of the liquid composition for ink jet recording is more than about 8.0 mPa·s, such a liquid composition may have deteriorated ejectability. On the other hand, when the viscosity is less than about 1.2 mPa·s, such a liquid composition may have deteriorated long-term jettability.

Water

The liquid composition for ink jet recording contains water in such a content that the liquid composition has a surface tension and a viscosity within the aforementioned ranges.

The content of water in the liquid composition for ink jet recording is not particularly limited, but is preferably about 30 to about 70% by mass, more preferably about 40 to about 65% by mass, and still more preferably about 50 to about 60% by mass. When the content of water is less than about 30% by mass, the organic acid(s) may easily precipitate. When the content of water exceeds about 70% by mass, evaporation of water may remarkably change the viscosity of the liquid composition.

Coloring Material

The liquid composition for ink jet recording may contain at least one coloring material. Each of the at least one coloring material may be selected from examples of the coloring material(s) contained in the ink for ink jet recording which examples will be described later. Each of the at least one coloring material is preferably a dye, a pigment having sulfonic acid or sulfonate on the surface thereof, an anionic self-dispersible pigment, or a cationic self-dispersible pigment. This is because such a dye or pigment is unlikely to aggregate in an acidic range and improves the storage stability of the liquid composition for ink jet recording.

Ink for Ink Jet Recording

Hereinafter, the ink for ink jet recording will be explained in detail. The ink for ink jet recording contains at least one coloring material, at least one water-soluble solvent, and water.

Each of the at least one coloring material contained in the ink for ink jet recording may be a dye or a pigment, and is preferably a pigment. The reason is thought to be as follows. A pigment is aggregated more easily at the time that the ink is mixed with the liquid composition than a dye. The pigment is preferably a pigment dispersion liquid in which pigment particles are dispersed with a polymer dispersant, a self-dispersible pigment, or a pigment covered with at least one resin.

The pigment in the invention may be either organic or inorganic. The pigment may be a black pigment such as carbon black, including furnace black, lamp black, acetylene black or channel black. Alternatively, the pigment in the invention may be any one of pigments having three primary colors of cyan, magenta and yellow, and those having a specific color such as red, green, blue, brown or white, those having metallic luster such as gold or silver color, extenders having no color or a light color, and plastic pigments. Alternatively, the pigment may be particles obtained by fixing a dye or a pigment to the surfaces of beads serving as cores, and each made of silica, alumina or a polymer, the insoluble lake substance of a dye, a colored emulsion or a colored latex. Moreover, the pigment may be a pigment developed newly.

Specific examples of the pigment used in the invention include, but are not limited to, RAVEN 7000, RAVEN 5750, RAVEN 5250, RAVEN 5000 Ultra II, RAVEN 3500, RAVEN 2000, RAVEN 1500, RAVEN 1250, RAVEN 1200, RAVEN 1190 ULTRA II, RAVEN 1170, RAVEN 1255, RAVEN 1080 and RAVEN 1060 (manufactured by Columbian Chemicals Company); REGAL 400R, REGAL 330R, REGAL 660R, MOGUL L, BLACK PEARLS L, MONARCH 700, MONARCH 800, MONARCH 880, MONARCH 900, MONARCH 1000, MONARCH 1100, MONARCH 1300 and MONARCH 1400 (manufactured by Cabot Corporation): COLOR BLACK FW1, COLOR BLACK FW2, COLOR BLACK FW2V, COLOR BLACK 18, COLOR BLACK FW200, COLOR BLACK S150, COLOR BLACK S160, COLOR BLACK S170, PRINTEX 35, PRINTEX U, PRINTEX V, PRINTEX 140U, PRINTEX 140V, SPECIAL BLACK 6, SPECIAL BLACK 5, SPECIAL BLACK 4A and SPECIAL BLACK 4 (manufactured by manufactured by Degussa Co.): and No. 25, No. 33, No. 40, No. 47, No. 52, No. 900, No. 2300, MCF-88, MA 600, MA 7, MA 8 and MA 100 (manufactured by Mitsubishi Chemical Co., Ltd.).

Examples of the cyan pigment include, but are not limited to, C.I. PIGMENT BLUE-1, -2, -3, -15, -15:1, -15:2, -15:3, -15:4, -16, -22 and -60.

Examples of the magenta pigment include, but are not limited to, C.I. PIGMENT RED-5, -7, -12, -48, -48:1, -57, -112, -122, -123, -146, -168, -184 and -202.

Examples of the yellow pigment include, but are not limited to, PIGMENT YELLOW-1, -2, -3, -12, -13, -14, -16, -17, -73, -74, -75, -83, 93, -95, -97, -98, -114, 128, -129, -138, -151, -154, -155 and -180.

The pigment that can be self-dispersible in water and used in the invention (self-dispersible pigment) refers to a pigment that has, on the surface thereof, many groups solubilizing itself in water and that can be stably dispersed in water without a polymer dispersant. The pigment self-dispersible in water is practically obtained by subjecting a so-called ordinary pigment to surface modification treatment such as acid or base treatment, coupling agent treatment, polymer graft treatment, plasma treatment and/or redox treatment.

In addition to the surface-modified pigments described above, one or more of commercially available pigments such as CAB-O-JET-200, CAB-O-JET-250, CAB-O-JET-260, CAB-O-JET-270, CAB-O-JET-300, IJX-444 and IJX-55 (manufactured by Cabot Corporation), and MICROJET BLACK CW-1 and CW-2 (manufactured by Orient Chemical Industries, Ltd.) may also be used as the pigment(s) self-dispersible in water.

The self-dispersible pigment serving as the coloring material contained in the ink for ink jet recording preferably has, on the surface thereof, at least one functional group including a carboxylic acid group. The reason for this is supposedly as follows. Carboxylic acid has a low degree of dissociation. Therefore, the organic acid may suppress dissociation of carboxylic acid and accelerate aggregation of the pigment.

When the coloring material contained in the ink for ink jet recording has at least one sulfonic acid group on the surface thereof, the ink for ink jet recording preferably contains a polymer compound having at least one carboxylic acid group (i.e., a resin having at least one carboxylic acid group) in addition to the coloring material. The coloring material having at least one sulfonic acid group on the surface thereof is hard to aggregate. For this, a printed matter obtained by using an ink set containing such a coloring material tend to have unimproved optical density, feathering and intercolorbleeding. On the other hand, when the ink for ink jet recording contains the polymer compound having at least one carboxylic acid group in addition to the above-described coloring material, mixing the ink for ink jet recording and the liquid composition results in insolubilization of the polymer compound. At this time, the pigment is taken in the insolubilized polymer compound and is thus aggregated. It is supposed that this may provide a printed matter obtained by using an ink set containing such a coloring material and such a polymer compound with improve optical density, feathering and intercolorbleeding.

The pigment coated with at least one resin may be used as the coloring material, as aforementioned. Such a pigment is called as a microcapsule pigment, which may be any of commercially available microcapsule pigments manufactured by Dainippon Ink & Chemicals, Inc. and Toyo Ink MFG Co., Ltd., and those prepared for use in the invention.

The dye that can be used in the invention may be either a water-soluble dye or a disperse dye. Specific examples of the water-soluble dye include C.I. DIRECT BLACK-2, -4, -9, -11, -17, -19, -22, -32, -80, -151, -154, -168, -171, -194 and -195; C.I. DIRECT BLUE-1, -2, -6, -8, -22, -34, -70, -71, -76, -78, -86, -112, -142, -165, -199, -200, -201, -202, -203, -207, -218, -236, -287 and -307; C.I. DIRECT RED-1, -2, -4, -8, -9, -11, -13, -15, -20, -28, -31, -33, -37, -39, -51, -59, -62, -63, -73, -75, -80, -81, -83, -87, -90, -94, -95, -99, -101, -110, -189 and 227; C.I. DIRECT YELLOW-1, -2, -4, -8, -11, -12, -26, -27, -28, -33, -34, -41, -44, -48, -58, -86, -87, -88, -132, -135, -142, -144 and -173; C.I. FOOD BLACK-1 and -2; C.I. ACID BLACK-1, -2, -7, -16, -24, -26, -28, -31, -48, -52, -63, -107, -112, -118, -119, -121, -156, -172, -194 and -208; C.I. ACID BLUE-1, -7, -9, -15, -22, -23, -27, -29, -40, -43, -55, -59, -62, -78, -80, -81, -83, -90, -102, -104, -111, -185, -249 and -254; C.I. ACID RED-1, -4, -8, -13, -14, -15, -18, -21, -26, -35, -37, -52, -110, -144, -180, -249, -257 and -289; and C.I. ACID YELLOW-1, -3, -4, -7, -11, -12, -13, -14, -18, -19, -23, -25, -34, -38, -41, -42, -44, -53, -55, -61, -71, -76, -78, -79 and -122.

Specific examples of the disperse dye include C.I. DISPERSE YELLOW-3, -5, -7, -8, -42, -54, -64, -79, -82, -83, -93, -100, -119, -122, -126, -160, -184:1, -186, -198, -204 and 224; C.I. DISPERSE ORANGE-13, -29, -31:1, -33, -49, -54, -66, -73, -119 and -163; C.I. DISPERSE RED-1, -4, -11, -17, -19, -54, -60, -72, -73, -86, -92, -93, -126, -127, -135, -145, -154, -164, -167:1, -177, -181, -207, -239, -240, -258, -278, -283, -311, -343, -348, -356 and -362; C.I. DISPERSE VIOLET-33; C.I. DISPERSE BLUE-14, -26, -56, -60, -73, -87, -128, -143, -154, -165, -165:1, -176, -183, -185, -201, -214, -224, -257, -287, -354, -365 and -368; and C.I. DISPERSE GREEN-6:1 and -9.

The content of the coloring material(s) in the ink for ink jet recording used in the invention is preferably about 0.1 to about 20% by mass, and more preferably about 1 to about 10% by mass. When the content of the coloring material(s) in the ink is less than about 0.1% by mass, sufficient optical density may not be obtained. When the content of the coloring material(s) in the ink is more than about 20% by mass, the jetting property of the ink may be unstable.

The volume average particle size of the coloring material particles in the ink for ink jet recording is preferably about 30 to about 250 nm. When an additive such as a dispersant adheres to the coloring material particles, the volume average particle size of the coloring material particles indicates the volume average size of a matter in which the additive adheres to the coloring material particles. In the invention, MICROTRACK UPA grain size analyzer 9340 (manufactured by Leeds & Northrup Co., Ltd.) is used to measure the volume average particle size. Specifically, the volume average particle size is measured as follows. Four milliliters of an ink is put in a measuring cell and the measuring cell is set in the analyzer and a predetermined measuring procedure is carried out. As for parameters input to the analyzer, the viscosity of the ink is used as "viscosity" and the density of the pigment contained in the ink is used as "the density of dispersed particles". The volume average particle size is more preferably about 50 to about 200 nm, and still more preferably about 75 nm to about 175 nm. When the volume average particle size of the coloring material particles in the ink is less than about 30 nm, the optical density of a printed matter obtained by using such an ink set may be low. On the other hand, when the volume average particle size is more than about 250 nm, storage stability of such an ink may not be ensured.

The ink for ink jet recording in the invention may include at least one polymer dispersant to disperse the coloring material(s).

As aforementioned, when the ink for ink jet recording includes the pigment(s) self-dispersible in water, the ink can also contain at least one polymer dispersant. Each of the at least one polymer dispersant may be a nonionic compound, an anionic compound, a cationic compound, or an amphoteric compound.

The polymer dispersant may be a homopolymer or a copolymer of at least one monomer having at least one α,β-ethylenic unsaturated group. Examples of the monomer having at least one α,β-ethylenic unsaturated group include acrylic acid, methacrylic acid, crotonic acid, itaconic acid, itaconic monoester, maleic acid, maleic monoester, fumaric acid, fumaric monoester, vinylsulfonic acid, styrenesulfonic acid, sulfonated vinylnaphthalene, vinyl alcohol, acrylamide, methacryloxyethyl phosphate, bismethacryloxyethyl phosphate, methacryloxyethylphenyl acid phosphate, ethylene glycol dimethacrylate, diethylene glycol dimethacrylate, styrene derivatives such as styrene, α-methylstyrene and vinyltoluene, vinylcyclohexane, vinylnaphthalene, vinylnaphthalene derivatives, alkyl acrylate, phenyl acrylate, alkyl methacrylate, phenyl methacrylate, cycloalkyl methacrylate, alkyl crotonate, dialkyl itaconate and dialkyl maleate.

Specific examples of the copolymer include styrene/styrenesulfonic acid copolymer, styrene/maleic acid copolymer, styrene/methacrylic acid copolymer, styrene/acrylic acid copolymer, vinylnaphthalene/maleic acid copolymer, vinylnaphthalene/methacrylic acid copolymer, vinylnaphthalene/acrylic acid copolymer, alkyl acrylate/acrylic acid copolymer, alkyl methacrylate/methacrylic acid copolymer, styrene/alkyl methacrylate/methacrylic acid terpolymer, styrene/alkyl acrylate/acrylic acid terpolymer, styrene/phenyl methacrylate/methacrylic acid terpolymer, and styrene/cyclohexyl methacrylate/methacrylic acid terpolymer.

The polymer dispersant that can be used in the ink for ink jet recording preferably has a weight-average molecular weight of about 2,000 to about 50,000. When the molecular weight is less than about 2,000, the coloring material particles may not be stably dispersed in the ink. When the molecular weight is more than about 50,000, the ink may have an increased viscosity and deteriorated ejectability. The molecular weight is more preferably about 3,500 to about 20,000.

The content of the polymer dispersant(s) in the ink for ink jet recording is preferably about 0.01 to about 3% by mass. When the content is higher than about 3% by mass, the ink may have an increased viscosity and an unstable jetting property. When the content is lower than about 0.01% by mass, the coloring material may be less stably dispersed in the ink. The content is more preferably about 0.05 to about 2.5% by mass, and still more preferably about 0.1 to about 2% by mass.

Water-Soluble Organic Solvent

The ink contains at least one water-soluble organic solvent similar to that contained in the liquid composition.

The content of the water-soluble organic solvent(s) in the ink is preferably about 1 to about 60% by mass, and more preferably about 5 to about 40% by mass. When the content of the water-soluble organic solvent(s) is less than about 1% by mass, a sufficient optical density may not be obtained. On the other hand, when the content of the water-soluble organic solvent(s) is more than about 60% by mass, such an ink may have an increased viscosity and an unstable jetting property.

Preferred Physical Characteristics of Ink for Ink Jet Recording

The surface tension of the ink for ink jet recording at 25° C. is preferably about 20 to about 60 mN/m, more preferably about 20 to about 45 mN/m, and still more preferably about 20 to about 35 mN/m. When the surface tension is less than about 20 mN/m, the ink may leak out of nozzles and may not be normally jetted from the nozzles. On the other hand, when the surface tension exceeds about 60 mN/m, penetration of such an ink into a recording medium may require longer time, which may lengthen a period from contact of the ink with the recording medium to drying.

The viscosity of the ink for ink jet recording is preferably about 1.2 to about 25.0 mPa·s, more preferably not less than about 1.5 mPa·s and less than about 10.0 mPa·s, and still more preferably not less than about 1.8 mPa·s and less than about 5.0 mPa·s. When the viscosity of the ink for ink jet recording is more than about 25.0 mPa·s, such an ink may have deteriorated ejectability. On the other hand, when the viscosity is less than about 1.2 mPa·s, such an ink may have a deteriorated jetting property.

Water

The ink for ink jet recording contains water in such a content that the ink has a surface tension and a viscosity within the above-described ranges. The content of water in the ink for ink jet recording is not particularly limited, but is preferably about 10 to about 99% by mass, and more preferably about 30 to about 80% by mass.

Additive in Ink and Liquid Composition for Ink Jet Recording

Hereinafter, additives that at least one of the ink and the liquid composition for ink jet recording may contain will be described in detail.

Each of the ink and the liquid composition for ink jet recording may contain at least one surfactant. A compound having both at least one hydrophilic portion and at least one hydrophobic portion in the molecule thereof can be effectively used as each of the at least one surfactant in the invention. Each surfactant may be an anionic surfactant, a cationic surfactant, an amphoteric surfactant, or a nonionic surfactant. The aforementioned polymer dispersant may be used as the surfactant.

The anionic surfactant may be alkylbenzenesulfonate, alkylphenylsulfonate, alkylnaphthalenesulfonate, a salt or sulfate or sulfonate of higher fatty acid, a sulfate or sulfonate of higher alcohol ether, higher alkyl sulfosuccinate, higher alkyl phosphate or a phosphate of an adduct obtained by adding ethylene oxide to higher alcohol. Specific examples thereof include dodecylbenzenesulfonate, kerylbenzenesulfonate, isopropylnaphthalenesulfonate, monobutylphenylphenol monosulfonate, monobutylbiphenylsulfonate and dibutylphenylphenol disulfonate.

Examples of the nonionic surfactant include an adduct obtained by adding ethylene oxide to polypropylene glycol, polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, fatty acid alkylolamide, acetylene glycol, an adduct obtained by adding oxyethylene to acetylene glycol, aliphatic alkanolamide, glycerin ester and sorbitan ester.

The cationic surfactant may be a tetraalkyl ammonium salt, an alkylamine salt, a benzalkonium salt, an alkyl pyridium salt or an imidazolium salt. Specific examples thereof include dihydroxyethyl stearylamine, 2-heptadecenyl-hydroxyethylimidazoline, lauryl dimethyl benzyl ammonium chloride, cetylpyridium chloride, and stearamide methylpyridium chloride.

At least one bio-surfactant such as spicrispolic acid, rhamnolipid or lysolecithin may also be used in the invention.

When the ink and/or the liquid composition contains at least one surfactant, the content of the surfactant(s) in the ink or the liquid composition is preferably less than about 10% by mass, more preferably about 0.01 to about 5% by mass, and still more preferably about 0.01 to about 3% by mass. When the content is equal to or more than about 10% by mass, the ink may provide images with deteriorated optical density. Moreover, when the ink includes a pigment in this case, the ink may have deteriorated storage stability.

To control characteristics, for example, to improve ejectability, the ink and/or the liquid composition for ink jet recording may contain any of polyethylenimine, polyamines, polyvinyl pyrolidone, polyethylene glycol, cellulose derivatives including ethyl cellulose and carboxymethyl cellulose, polysaccharides and derivatives thereof, water-soluble polymers, polymer emulsions such as acrylic polymer emulsion, polyurethane emulsion and hydrophilic latex, hydrophilic polymer gel, cyclodextrin, macrocyclic amines, dendrimers, crown ethers, urea and derivatives thereof, acetamide, silicone-containing surfactants and fluorine-containing surfactants.

To control pH and conductivity, the ink and/or the liquid composition for ink jet recording may contain any of alkali metal compounds such as potassium hydroxide, sodium hydroxide and lithium hydroxide, nitrogen-containing compounds such as ammonium hydroxide, triethanolamine, diethanolamine, ethanolamine and 2-amino-2-methyl-1-propanol, alkaline earth metal compounds such as calcium hydroxide, acids such as sulfuric acid, hydrochloric acid and nitric acid, and salts of strong acid and an alkalescent substance such as ammonium sulfate.

The ink and/or the liquid composition for ink jet recording may also contain any other additive(s) such as at least one pH buffer, at least one antioxidant, at least one fungicide, at least one viscosity control agent, at least one electrically conductive agent and/or at least one UV absorbent, if necessary.

The ink and the liquid composition for ink jet recording of the invention can be used in an ink jet recording apparatus that has a unit for controlling the drying property of the ink such as a heater, or an ink jet recording apparatus that has an intermediate transferring mechanism and in which the ink is transferred to an intermediate transfer member and is then transferred to a recording medium such as paper, as well as an ordinary ink jet recording apparatus. The liquid composition for ink jet recording can be applied to a recording medium in accordance with a method other than an ink jet recording method. In the method, for example, a liquid application roller can be used.

Ink Tank for Ink Jet Recording

An ink tank for ink jet recording used in the invention stores the liquids of the ink set for ink jet recording of the invention, that is, the ink and the liquid composition for ink jet recording. The ink tank for ink jet recording can be an ink tank described in, for example, JP-A No. 2001-138541. In this case, deterioration in the properties of an ink may be suppressed, even when the ink is stored in the ink tank for a long period of time. For this reason, even such a long-term stored ink may be satisfactorily ejected from a recording head.

Ink Jet Recording Method and Ink Jet Recording Apparatus

In the ink jet recording method of the invention, the ink set for ink jet recording is used. Each of the liquids (i.e., ink and liquid composition for ink jet recording) of the ink set is ejected and made to adhere to a recording medium so that the ink for ink jet recording is brought into contact with the liquid composition on the recording medium. Thus, an image is formed.

In the ink jet recording apparatus of the invention, the ink set for ink jet recording is used. The ink jet recording apparatus has a recording head for ejecting the liquids of the ink set for ink jet recording to a recording medium. As aforementioned, the ink jet recording apparatus can be a recording apparatus that has a unit for controlling drying of the ink such as a heater, or a recording apparatus that has an intermediate transfer mechanism and in which the ink is transferred to an intermediate transfer member and is then transferred to a recording material such as paper, as well as an ordinary ink jet recording apparatus.

In the ink jet recording method or apparatus of the invention, the volume of one drop of each of the ink and the liquid composition is preferably about 1 to about 200 pl, more preferably about 1 to about 100 pl, and still more preferably about 1 to about 80 pl. When the volume is more than about 200 pl, a printed matter may have a deteriorated resolution. The reason for this is thought to be as follows. The contact angle between the ink or liquid composition and a recording medium depends on the amount of one drop of the ink or liquid composition. As the volume of one drop increases, each drop tends to spread on the surface of the recording medium such as paper. When the volume of one drop is less than about 1 pl, such an ink or liquid composition may have deteriorated ejection stability.

When the ink jet recording apparatus of the invention has nozzles each of which can eject drops having various volumes, the volume of one drop indicates the volume of one drop that can be ejected by such an ink jet recording apparatus and that has the smallest volume.

When the ink set for ink jet recording is used, the ink and the liquid composition for ink set recording are made to adhere to a recording medium and brought into contact with each other on the recording medium. When the ink and the liquid composition has been brought into contact with each other, the ink is aggregated by the action of the aggregating component(s). Thus, the ink jet recording method provides excellent color development, less unevenness in solid portions, excellent optical density, less feathering and intercolorbleeding, and shortened drying time. In bringing the ink into contact with the liquid composition on the recording medium, the ink and the liquid composition may be made to adhere to the recording medium so that they adjoin each other. Alternatively, the ink may be covered with the liquid composition, or vice versa.

The order by which the ink and the liquid composition are made to adhere to the recording medium is that the liquid composition for ink jet recording is made to adhere thereto, and the ink for ink jet recording is then made to adhere thereto. By making the liquid composition first adhere to the recording medium, it becomes possible to effectively aggregate the components of the ink for ink jet recording. The ink for ink jet recording can be made to adhere to the recording medium anytime, as long as the liquid composition for ink jet recording is in advance made to adhere thereto. The ink is preferably made to adhere to the recording medium, when a time of about 0.5 seconds or less has lapsed since adhesion of the liquid composition.

In the ink jet recording method or apparatus of the invention, the ratio of the mass of the ink which mass is necessary to form one pixel to that of the liquid composition is preferably 1:20 to 20:1, more preferably 1:10 to 10:1, and still more preferably 1:5 to 5:1. When the amount of the ink is much smaller or larger than that of the liquid composition, the ink may be insufficiently aggregated, which may result in decreased optical density and worsened feathering and intercolorbleeding. The term "pixel" used herein refers to one of lattice points into which a desired image is divided and each of which has the minimum distance by which the ink can adhere to a recording medium in the main scanning direction and that in the sub scanning direction. An appropriate ink set is made to adhere to each of the pixels, so that an image having adjusted color and image density is formed.

In particular, the ratio of the volume of the liquid composition for ink jet recording which volume is necessary to form one pixel to that of the ink for ink jet recording is preferably about 60 vol. % or less, more preferably about 5 to about 50 vol. %, and still more preferably about 10 to about 30 vol. %.

From the viewpoint of suppression of feathering and intercolorbleeding, the ink jet recording method and apparatus of the invention preferably utilize a thermal ink jet recording process or a piezo ink jet recording process. The reason for this is supposedly as follows. In the thermal ink jet recording process, an ink is heated and therefore has a low viscosity when jetted. The temperature of the ink lowers on a recording medium and the viscosity of the ink, therefore, rapidly increases. This may suppress feathering and intercolorbleeding. In the piezo ink jet process, it is possible to jet a highly viscous liquid, which is unlikely to spread on a recording medium, suppressing feathering and intercolorbleeding.

In the ink jet recording method or apparatus of the invention, each of the ink and the liquid composition is preferably replenished (supplied) to a recording head with an ink tank (including an ink componential tank and a liquid composition componential tank) that is filled with the ink and the liquid composition. This tank is preferably a cartridge that can be attached to and detached from the apparatus, and each of the ink and the liquid composition is easily replenished by changing such an ink or liquid composition tank cartridge.

A preferred exemplary embodiment of the ink jet recording apparatus of the invention will be described below in detail, while referring to the drawings. In the drawings, members having substantially the same function have the same reference numeral and repetitive description will be omitted.

Figure 2:
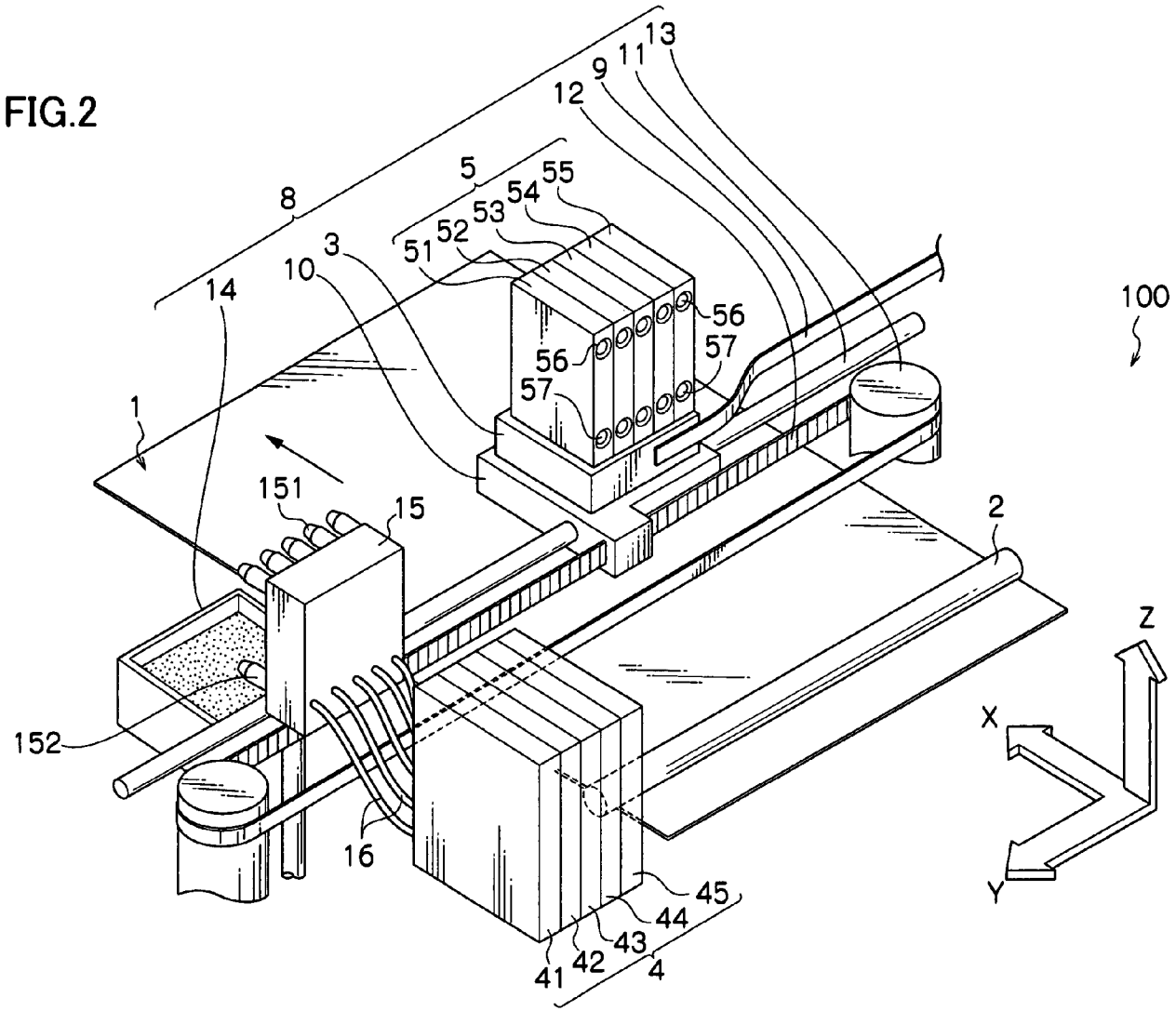
FIG. 2 is a perspective view showing the basic configuration of the interior of the ink jet recording apparatus shown in FIG. 1.

FIG. 1 is a perspective view showing the exterior structure of a preferred exemplary embodiment of the ink jet recording apparatus of the invention. FIG. 2 is a perspective view showing the basic configuration of the interior of the ink jet recording apparatus shown in FIG. 1 (that will be hereinafter referred to as an image forming apparatus).

An image forming apparatus 100 in this exemplary embodiment has a configuration that operates in accordance with the ink jet recording method of the invention to form images. Specifically, as shown in FIGS. 1 and 2, the basic configuration of the image forming apparatus 100 is composed of an outer cover 6, a tray 7 on which a predetermined amount of recording media 1 such as plain paper can be placed, a transportation roller (transportation unit) 2 for feeding the recording media 1 to the inside of the image forming apparatus 100 one by one, an image forming unit 8 for ejecting inks of respective colors and a liquid compound to the surface of a recording medium 1 so as to form an image, and a main ink tank 4. The image forming unit 8 has a sub ink tank 5, and the inks and the liquid composition are supplied from the main ink tank 4 to the sub ink tank 5.

The transportation roller 2 is a paper-feeding mechanism and provided rotatably in the image forming apparatus 100. The transportation roller 2 holds the recording media 1 set on the tray 7 and feeds a predetermined number of the recording media 1 to the inside of the image forming apparatus 100 one by one in predetermined timing.

The image forming unit 8 forms an image on the surface of a recording medium 1 with inks. The basic configuration of the image forming unit 8 is composed of a recording head 3, a feeding signal cable 9, a carriage 10, a guide rod 11, a timing belt 12, driving pulleys 13, and a maintenance unit 14, as well as the sub ink tank 5.

The sub ink tank 5 is composed of componential tanks 51, 52, 53, 54, and 55 (i.e., ink componential tanks and a liquid composition componential tank) for respectively storing the inks and the liquid composition, which are to be ejected from the recording head 3. These componential tanks 51 to 55 contain, for example, a black ink (K), a yellow ink (Y), a magenta ink (M), a cyan ink (C), and the liquid composition that are replenished from the main ink tank 4.

Each of the componential tanks 51-55 has an exhaust hole 56 and a replenishing hole 57. When the recording head 3 is moved and disposed at a stand-by position (or a replenishing position), a pin for exhaust 151 and a pin for replenishing 152 are inserted into the exhaust hole 56 and the replenishing hole 57, respectively to connect the componential ink tanks 51-55 to the replenishing unit 15. The replenishing unit 15 is connected to the main ink tank 4 through a replenishing tube 16. The ink and/or the liquid composition is replenished from the main ink tank 4 to the sub ink tank 5 through the replenishing hole 57.

The main ink tank 4 has componential tanks 41, 42, 43, 44, 45 (i.e., ink componential tanks and a liquid composition componential tank) that respectively store inks of respective colors, for example, a black ink (K), a yellow ink (Y), a magenta ink (M), and a cyan ink (C) serving as inks for ink jet recording, and the liquid composition (for ink jet recording). Each of these componential tanks is removably set in the image forming apparatus 100.

The feeding signal cable 9 is electrically connected to the recording head 3 and the sub ink tank 5 is connected thereto. When external image recording information is input from the feeding signal cable 9 to the recording head 3, the recording head 3 sucks predetermined amounts of the inks and the liquid composition from the respective componential tanks of the sub ink tank 5 and ejects the inks and the liquid composition onto the surface of a recording medium in accordance with the image recording information. The feeding signal cable 9 also supplies, to the recording head 3, power necessary to drive the recording head 3 in addition to the image recording information.

Moreover, the recording head 3 is disposed on and held by the carriage 10. The carriage 10 has a short through hole and a long through hole. The timing belt 12 is wound around the driving pulleys 13 and lead through the short through hole. The guide rod 11 is lead through the long through hole. Such a structure enables the recording head 3 to move along the guide rod 11 in a direction Y (a main-scanning direction) that is parallel with the surface of the recording medium 1 and that is perpendicular to the transportation direction X (a sub-scanning direction) of the recording medium 1.

The image forming apparatus 100 also has a controller (not shown) for controlling driving timings of the recording head 3 and the carriage 10 in accordance with the image recording information. Consequently, it is possible to continuously form an image in a predetermined region of the surface of the recording medium 1, which is being transported in the transportation direction X at a predetermined speed, in accordance with the image recording information.

The maintenance unit 14 is connected to a pressure-reducing device (not shown) through a tube. Furthermore, the maintenance unit 14 is connected to the nozzles of the recording head 3 and thereby can reduce the internal pressure of each of the nozzles to suck the inks and the liquid composition from the nozzles. Providing the maintenance unit 14 makes it possible to remove excessive inks and liquid composition adhering to portions of the surface of the recording head that are in the vicinities of the openings of the nozzles during operation of the image forming apparatus 100 or to suppress evaporation of the inks and the liquid composition from the nozzles at the time that operation of the image forming apparatus 100 is being stopped, according to necessity.

Figure 3:
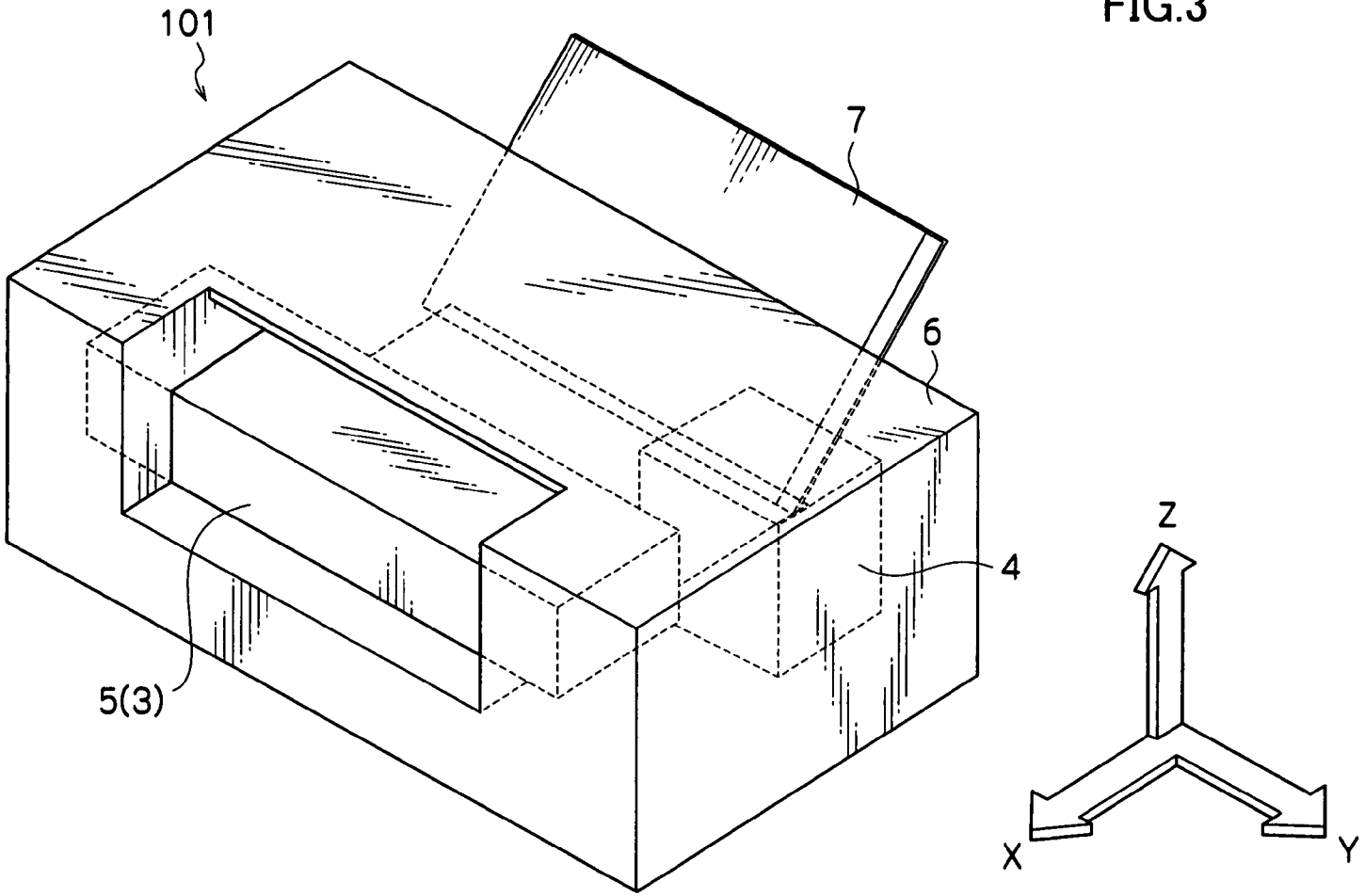
FIG. 3 is a perspective view showing the exterior configuration of another preferred exemplary embodiment of the ink jet recording apparatus of the invention.
Figure 4:
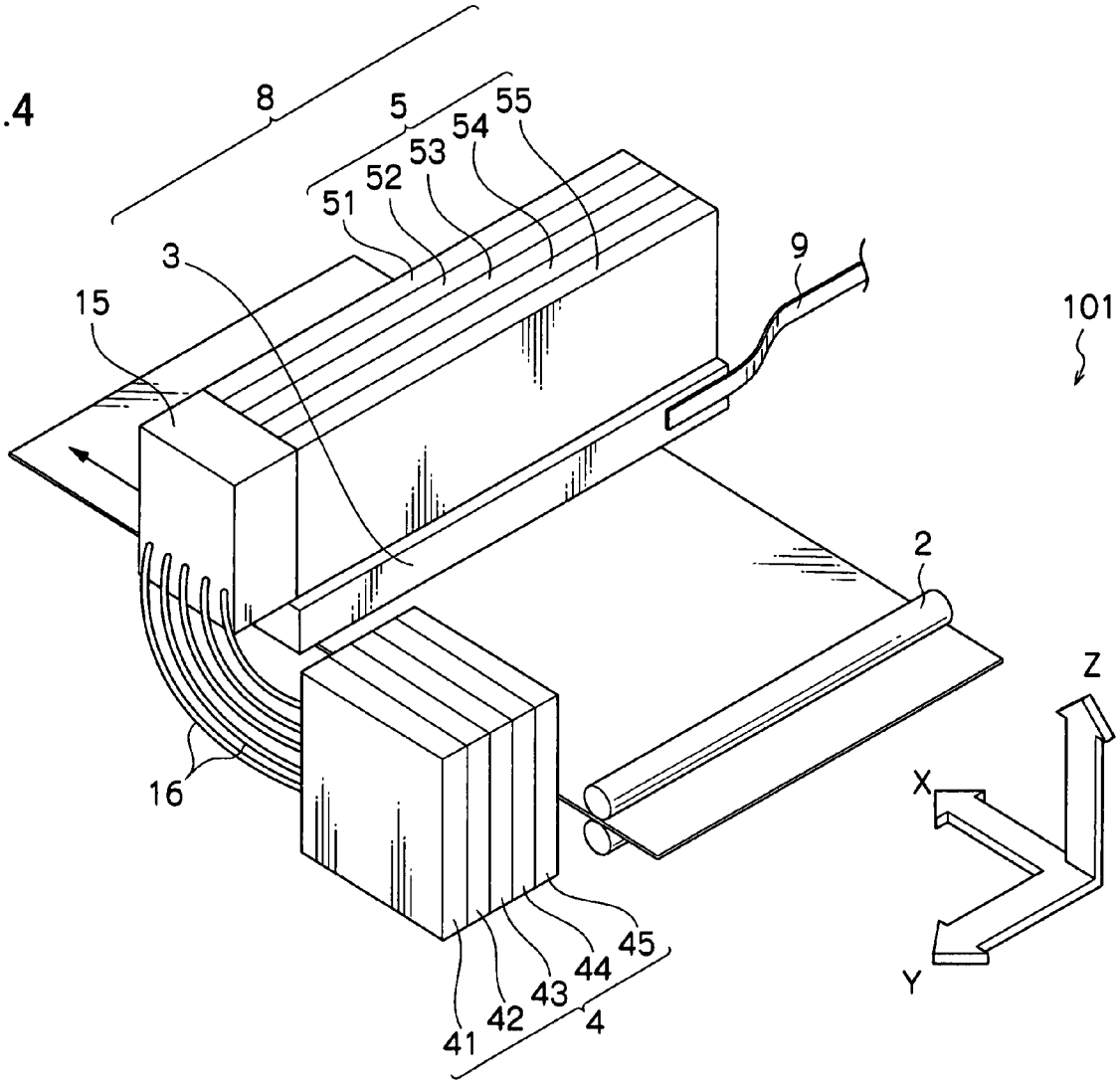
FIG. 4 is a perspective view showing the basic configuration of the interior of the ink jet recording apparatus shown in FIG. 3.

FIG. 3 is a perspective view showing the exterior configuration of another preferred exemplary embodiment of the ink jet recording apparatus of the invention. FIG. 4 is a perspective view showing the basic configuration of the interior of the ink jet recording apparatus (that will be hereinafter referred to as an image forming apparatus) shown in FIG. 3. An image forming apparatus 101 of this embodiment has a configuration that is operated in accordance with the ink jet recording method of the invention to form an image.

The image forming apparatus 101 shown in FIGS. 3 and 4 includes a recording head 3 that has a width equal to or greater than that of a recording medium 1, and therefore does not include a carriage mechanism. The image forming apparatus 101 also has, as a paper-feeding mechanism, a pair of transportation rollers 2 that sandwich the recording medium 1 and feed the recording medium 1 in the sub scanning direction (the transportation direction of the recording medium 1, namely the direction of an arrow X). The paper-feeding mechanism in this exemplary embodiment may also be a belt.

The recording head 3 has a sub ink tank 5 composed of componential tanks 51 to 55 arranged in the sub scanning direction and nozzles (not shown) for respectively ejecting inks of different colors and a liquid composition arranged in the sub scanning direction. The other components of the image forming apparatus 101 are the same as those of the image forming apparatus 100 shown in FIGS. 1 and 2, and detailed explanations for those components are omitted. Since the recording head 3 does not move, the sub ink tank 5 is always connected to the replenishing unit 15. However, the sub ink tank 5 may be connected to the replenishing unit 15, only when at least one of new inks and liquid composition should be replenished to the sub ink tank 5.

The image forming apparatus 101 shown in FIGS. 3 and 4 carries out printing in the transverse direction (sub scanning direction) of the recording medium 1 in block by means of the recording head 3. Therefore, this apparatus has a simpler structure and a higher printing speed than the image forming apparatus 100, which has a carriage mechanism.

EXAMPLES

More specific descriptions will be given to the invention by taking examples. These examples do not restrict the scope of the invention.

Manufacture of Ink and Liquid Composition

According to the following compositions of inks and liquid compositions, the compounds are mixed and stirred, and the resultant mixtures are filtered with a membrane filter having a pore diameter of 5 um, and desired inks and liquid composition are obtained.

Ink A

CABOJET-300 (manufactured by Cabot corporation) 4% by mass (self-dispersible pigment having a volume average particle diameter of 100 nm)

Styrene-acrylic acid copolymer (partially neutralized with NaOH) 0.5% by mass
Diethylene glycol 10% by mass
Glycerin 5% by mass
2-Pyrolidone 5% by mass
Adduct obtained by adding ethylene oxide to acetylene glycol 1% by mass
Deionized water the remainder
The ink has a viscosity of 3.3 mPa·s, and a surface tension of 31 mN/m, and includes coloring material particles having a volume average particle diameter of 98 nm.

Ink B
C.I. PIGMENT BLUE-15:3 5% by mass
Styrene-acrylic acid-sodium acrylate terpolymer 1.0% by mass (weight-average molecular weight of 4,000)
Diethylene glycol 20% by mass
Butyl carbitol 5% by mass
Polyoxyethylene 2-ethylhexyl ether 0.75% by mass
Deionized water the remainder
The ink has a viscosity of 3.1 mPa·s, and a surface tension of 30 mN/m, and includes coloring material particles having a volume average particle diameter of 92 nm.

Ink C
C.I. PIGMENT RED 122 5% by mass
Styrene-acrylic acid-sodium acrylate terpolymer 0.9% by mass (weight-average molecular weight of 4,000)
Diethylene glycol 20% by mass
Glycerin 5% by mass
Polyoxyethylene 2-ethylhexyl ether 0.75% by mass
Deionized water the remainder
The ink has a viscosity of 3.4 mPa·s, and a surface tension of 32 mN/m, and includes coloring material particles having a volume average particle diameter of 96 nm.

Liquid Composition A
Succinic acid 5% by mass
Diethylene glycol 23% by mass
Butyl carbitol 4% by mass
Lithium hydroxide 0.72% by mass
Sodium hydroxide 0.80% by mass
Adduct obtained by adding ethylene oxide to acetylene glycol 1% by mass
Deionized water the remainder
The liquid composition has a pH of 3.9, a surface tension of 30 mN/m, and a viscosity of 3.1 mPa·s.

Liquid Composition B
2-Pyrolidonecarboxylic acid 11% by mass
Diethylene glycol 23% by mass
2-Pyrolidone 4% by mass
Lithium hydroxide 0.67% by mass
Ammonia 1.0% by mass
Adduct obtained by adding ethylene oxide to acetylene glycol 1% by mass
Deionized water the remainder
The liquid composition has a pH of 4.0, a surface tension of 31 mN/m, and a viscosity of 3.1 mPa·s.

Liquid Composition C
Citric acid 6.4% by mass
Diethylene glycol 23% by mass
1,2-Hexanediol 4.5% by mass
Lithium hydroxide 1.4% by mass
Tetramethyl ammonium hydroxide 1.4% by mass
Adduct obtained by adding ethylene oxide to acetylene glycol 1% by mass
Deionized water the remainder
The liquid composition has a pH of 4.1, a surface tension of 29 mN/m, and a viscosity of 3.0 mPa·s.

Liquid Composition D
2-Furancarboxylic acid 5.0% by mass
Glycerin 20% by mass
1,2-Hexanediol 4% by mass
Lithium hydroxide 0.45% by mass
Potassium hydroxide 0.72% by mass
Adduct obtained by adding ethylene oxide to acetylene glycol 1% by mass
Deionized water the remainder
The liquid composition has a pH of 5.1, a surface tension of 29 mN/m, and a viscosity of 2.9 mPa·s.

Liquid Composition E
Itaconic acid 6.5% by mass
Glycerin 20% by mass
2-Pyrolidone 4% by mass
Lithium hydroxide 0.31% by mass
Potassium hydroxide 0.73% by mass
Adduct obtained by adding ethylene oxide to acetylene glycol 1% by mass
Deionized water the remainder
The liquid composition has a pH of 3.8, a surface tension of 30 mN/m, and a viscosity of 2.9 mPa·s.

Liquid Composition F
2-Pyrolidonecarboxylic acid 11% by mass
Diethylene glycol 23% by mass
2-Pyrolidone 4% by mass
Lithium hydroxide 1.4% by mass
Dimethylamine 1.1% by mass
Adduct obtained by adding ethylene oxide to acetylene glycol 1% by mass
Deionized water the remainder
The liquid composition has a pH of 5.2, a surface tension of 31 mN/m, and a viscosity of 3.1 mPa·s.

Liquid Composition G
2-Pyrolidonecarboxylic acid 3.0% by mass
Glycerin 25% by mass
Butyl carbitol 5% by mass
Lithium hydroxide 0.25% by mass
Ammonia 0.16% by mass
Adduct obtained by adding ethylene oxide to acetylene glycol 1% by mass
Deionized water the remainder
The liquid composition has a pH of 6.1, a surface tension of 31 mN/m, and a viscosity of 3.1 mPa·s.

Liquid Composition H
Oxalic acid 4.5% by mass
Glycerin 20% by mass
2-Pyrolidone 4% by mass
Lithium hydroxide 1.56% by mass
Adduct obtained by adding ethylene oxide to acetylene glycol 1% by mass
Deionized water the remainder
The liquid composition has a pH of 3.8, a surface tension of 30 mN/m, and a viscosity of 2.9 mPa·s.

Liquid Composition I
Citric acid 6.4% by mass
Diethylene glycol 20% by mass
1,2-Hexanediol 5% by mass
Lithium hydroxide 1.7% by mass
2-Aminoethanol 1.8% by mass
Adduct obtained by adding ethylene oxide to acetylene glycol 1% by mass
Deionized water the remainder The liquid composition has a pH of 6.6, a surface tension of 29 mN/m, and a viscosity of 3.0 mPa·s.

The content of each of the components contained in each of these liquid compositions are shown in Table 1.

Examples 1 to 8 and Comparative Example 1

In Examples 1 to 8 and Comparative Example 1, ink sets shown in Table 2 are used to form images, and the optical density of each of the images and the frequency of clogging in a printer are measured and evaluated in accordance with the following procedures.

Evaluation

Optical Density

An image is printed on a recording medium (FX-$C^2$ paper manufactured by Fuji Xerox Corporation) with a printer that includes a trial piezo print head having 1024 nozzles (the amount of one dropt is 14 ng) at 600 dpi in accordance with a method including ejecting the liquid composition onto the FX-$C^2$ paper and then ejecting an ink on the portion of the paper to which the liquid composition has adhered. The printing is performed under a general environment (temperature of 23±0.5° C., and humidity of 55±5% R.H). The mass ratio of the amount of the ink which amount is necessary to form one pixel to that of the liquid composition is 1:0.2.

The optical density of the printed portion is measured with a densitometer, or X-RITE 404 (X-Rite Corporation). The results are shown in Table 2.

Evaluation Criteria (for Black Ink)

A Optical density is 1.4 or more.

B Optical density is 1.2 or more and less than 1.4.

C Optical density is less than 1.2.

Evaluation Criteria (for Color Ink)

A Optical density is 1.2 or more.

B Optical density is 1.0 or more and less than 1.2.

C Optical density is less than 1.0.

Clogging

After the print head is capped and then left unused for a month under the general environment (temperature of 23±0.5° C., and humidity of 55±5% RH), dummy ejections of the ink and the liquid composition are performed 1000 times without maintenance. Thereafter, the number of nozzles that cannot eject the ink or the liquid composition is measured, and the ratio of such nozzles to all the nozzles is calculated and evaluated in the following criteria. The results are shown in Table 2.

Evaluation Criteria

A The ratio is less than 5%.

B The ratio is 5% or more and less than 10%.

C The ratio is 10% or more and less than 20%.

D The ratio is 20% or more.

TABLE 1

| Liquid Composition | Addition Amount of Organic Acid (mol/L) | Neutralization Degree of Organic Acid (%) | Ratio of Water-Soluble Organic Solvent to Organic Acid (times) | Addition Amount of Each Kind of Positive Ion (% by mass) | Content of Lithium in Positive Ion (mol %) |
|---|---|---|---|---|---|
| Liquid Composition A | 0.085 | 60 | 5.7 | LiOH (0.72)/NaOH (0.8) | 60 |
| Liquid Composition B | 0.085 | 70 | 3.1 | LiOH (0.67)/$NH_3$ (1.0) | 49 |
| Liquid Composition C | 0.1 | 75 | 7.5 | LiOH (1.4)/TMAH (1.4) | 79 |
| Liquid Composition D | 0.045 | 70 | 5.6 | LiOH (0.45)/KOH (0.72) | 59 |
| Liquid Composition E | 0.1 | 65 | 5 | LiOH (0.31)/KOH (0.73) | 50 |
| Liquid Composition F | 0.085 | 97 | 3.1 | LiOH (1.4)/ Dimethylamine (1.1) | 71 |
| Liquid Composition G | 0.023 | 65 | 13 | LiOH (0.25)/$NH_3$ (0.16) | 70 |
| Liquid Composition H | 0.1 | 62 | 5.3 | LiOH (1.56) | 100 |
| Liquid Composition I | 0.1 | 100 | 6.9 | LiOH (1.7)/ 2-Aminoethanol (1.8) | 71 |

TABLE 2

| | Type of Ink | Type of Liquid Composition | Clogging | Optical Density (OD) |
|---|---|---|---|---|
| Example 1 | A | A | B | A |
| Example 2 | B | B | B | A |
| Example 3 | C | C | B | A |
| Example 4 | A | D | B | B |
| Example 5 | B | E | C | A |
| Example 6 | C | F | B | B |
| Example 7 | A | G | B | C |
| Comparative Example 1 | B | H | D | A |
| Example 8 | C | I | B | C |

The table shows the following. Clogging hardly occurs, and the printed image generally has a high optical density and high quality in Examples, in comparison with Comparative Example 1. In particular, not only clogging hardly occurs but also the optical density is high in Examples 1 to 3.

What is claimed is:

1. A liquid composition for ink jet recording comprising an organic acid having a neutralization degree of about 40 to 100%, a water-soluble organic solvent, water, and two or more kinds of positive ions including lithium ions, the content of the lithium ions with respect to the total mol number of the positive ions being about 20 to about 95 mol, wherein one or more kinds of the positive ions other than the lithium ions are selected from alkali metal ions, organic amines, and onium ions.

2. The liquid composition for ink jet recording of claim 1, wherein the added molar amount of the water-soluble organic solvent is at least 1.5 times the added molar amount of the organic acid.

3. The liquid composition for ink jet recording of claim 1, wherein the content of the organic acid in the liquid composition is about 0.03 mol/liter to about 0.2 mol/liter.

4. The liquid composition for ink jet recording of claim 1, wherein the content of the organic acid in the liquid composition is about 0.03 mol/liter to about 0.2 mol/liter.

5. The liquid composition for ink jet recording of claim 1, wherein the content of the water in the liquid composition is about 30% by mass to about 70% by mass.

6. The liquid composition for ink jet recording of claim 4, wherein the content of the water in the liquid composition is about 30% by mass to about 70% by mass.

7. The liquid composition for ink jet recording of claim 1, wherein the liquid composition has a surface tension of about 20 to about 50 mN/m.

8. The liquid composition for ink jet recording of claim 6, wherein the liquid composition has a surface tension of about 20 to about 50 mN/m.

9. The liquid composition for ink jet recording of claim 1, wherein the liquid composition has a pH of about 2.5 to about 6.0.

10. The liquid composition for ink jet recording of claim 8, wherein the liquid composition has a pH of about 2.5 to about 6.0.

11. An ink set for ink jet recording comprising:

an ink including a coloring material, a water-soluble solvent, and water; and the liquid composition for ink jet recording of claim 1.

12. An ink tank for ink jet recording, storing the ink and the liquid composition of the ink set for ink jet recording of claim 11.

13. An ink jet recording method comprising ejecting the ink and the liquid composition of the ink set for ink jet recording of claim 11 onto a recording medium so as to contact each other to form an image.

14. An inkjet recording apparatus comprising a recording head for ejecting the ink and the liquid composition of the ink set for ink jet recording of claim 11 onto a recording medium.

15. The liquid composition for ink jet recording of claim 1, wherein a compound containing the lithium ions is lithium hydroxide, and a compound containing the one or more kinds of the positive ions other than the lithium ions is selected from the group consisting of sodium hydroxide, potassium hydroxide, sodium chloride, potassium chloride, sodium bromide, potassium bromide, sodium iodide, potassium iodide, sodium sulfate, potassium nitrate, potassium oxalate, sodium citrate, potassium benzoate, organic amines, and a compound containing onium ions.

* * * * *